US010422533B2

(12) United States Patent
Cai et al.

(10) Patent No.: US 10,422,533 B2
(45) Date of Patent: Sep. 24, 2019

(54) COMBUSTOR WITH AXIALLY STAGED FUEL INJECTOR ASSEMBLY

(71) Applicant: General Electric Company, Schenectady, NY (US)

(72) Inventors: Jun Cai, Greenville, SC (US); David William Cihlar, Greenville, SC (US); Hasan Karim, Greenville, SC (US)

(73) Assignee: General Electric Company, Schenectady, NY (US)

( * ) Notice: Subject to any disclaimer, the term of this patent is extended or adjusted under 35 U.S.C. 154(b) by 307 days.

(21) Appl. No.: 15/411,264

(22) Filed: Jan. 20, 2017

(65) Prior Publication Data

US 2018/0209651 A1 Jul. 26, 2018

(51) Int. Cl.

| | |
|---|---|
| ***F23R 3/00*** | (2006.01) |
| ***F23R 3/28*** | (2006.01) |
| ***F23R 3/34*** | (2006.01) |
| *F23R 3/14* | (2006.01) |

(52) U.S. Cl.

CPC ..... *F23R 3/283* (2013.01); *F23R 3/286* (2013.01); *F23R 3/346* (2013.01); *F23K 2301/203* (2013.01); *F23R 3/14* (2013.01); *F23R 2900/03042* (2013.01)

(58) Field of Classification Search

CPC .. F23R 3/346; F23R 3/283; F23R 3/14; F23R 3/03; F23R 3/286; F23K 2301/203

See application file for complete search history.

(56) References Cited

U.S. PATENT DOCUMENTS

| | | | | |
|---|---|---|---|---|
| 5,675,971 | A * | 10/1997 | Angel | F23R 3/286 239/405 |
| 8,407,892 | B2 | 4/2013 | DiCintio et al. | |
| 8,919,137 | B2 | 12/2014 | DiCintio et al. | |
| 9,010,120 | B2 | 4/2015 | DiCintio et al. | |
| 2007/0193273 | A1* | 8/2007 | DeVane | F23R 3/002 60/752 |
| 2010/0229557 | A1* | 9/2010 | Matsumoto | F23R 3/34 60/737 |
| 2011/0277481 | A1 | 11/2011 | Bhagat | |
| 2013/0031783 | A1 | 2/2013 | DiCintio et al. | |
| 2013/0031906 | A1 | 2/2013 | DiCintio et al. | |

OTHER PUBLICATIONS

U.S. Appl. No. 15/335,538, filed Oct. 27, 2016.

* cited by examiner

*Primary Examiner* — Craig Kim
*Assistant Examiner* — Katheryn A Malatek
(74) *Attorney, Agent, or Firm* — Dority & Manning, P.A.

(57) ABSTRACT

A fuel injector assembly for a combustor including an axially staged fuel injector includes an injector body having an inner wall and a boss that is rigidly connected to the injector body the boss includes an inner wall. The inner wall of the boss and the inner wall of the injector body together define a flow passage of the fuel injector assembly. The injector body defines an inlet to the flow passage and the boss defines an outlet of the flow passage.

15 Claims, 2 Drawing Sheets

COMBUSTOR WITH AXIALLY STAGED FUEL INJECTOR ASSEMBLY

FIELD

The present invention generally involves a combustor assembly. More specifically, the invention relates to a combustor including an axially staged fuel injector assembly.

BACKGROUND

A gas turbine engine generally includes a compressor section, a combustion section, and a turbine section. The combustion section typically includes at least one combustor which includes a fuel nozzle and a combustion liner positioned within a combustor casing. The combustion liner defines a primary combustion chamber within the combustor downstream from the fuel nozzle. The combustion liner may be circumferentially surrounded by a sleeve such as an impingement sleeve or a flow sleeve.

The sleeve is radially spaced from the combustion liner and a flow or cooling passage is defined therebetween. In particular configurations, a fuel injector extends radially through the sleeve, the cooling passage and the combustion liner. The fuel injector is axially staged or positioned downstream from the fuel nozzle(s). In particular configurations, a boss extends from the sleeve to the liner. The boss defines and/or circumferentially surrounds an opening in the combustion liner. The fuel injector extends radially within the boss and terminates proximate to the opening in the combustion liner. In order to accommodate the fuel injector, the boss must be sized larger than the fuel injector.

During operation of the combustor, compressed air flows through the cooling passage, past the boss and into a head-end volume of the combustor. The relatively large boss creates a bluff body or flow restriction within the cooling passage which results in non-uniform flow through the cooling passage upstream from the head-end volume. Once the compressed air reaches the head-end volume, it reverses flow direction and enters the fuel nozzle and/or the primary combustion chamber. Non-uniformity of the compressed air flowing into the head-end volume and into the fuel nozzle may effect overall combustor performance.

BRIEF DESCRIPTION

Aspects and advantages are set forth below in the following description, or may be obvious from the description, or may be learned through practice.

One embodiment of the present disclosure is a fuel injector assembly. The fuel injector assembly includes an injector body having an inner wall and a boss that is rigidly connected to the injector body and that includes an inner wall. The inner wall of the boss and the inner wall of the injector body together define a flow passage of the fuel injector assembly. The injector body defines an inlet to the flow passage and the boss defines an outlet of the flow passage.

Another embodiment of the present disclosure is a combustor. The combustor includes a combustion liner that defines a hot gas path within the combustor and a first radial opening. The combustor further includes a fuel injector assembly including an injector body having an inner wall and a boss including an inner wall. An upstream end of the boss is rigidly connected to the injector body and a downstream end of the boss is connected to the combustion liner. The inner wall of the boss and the inner wall of the injector body together define a flow passage of the fuel injector assembly. The flow passage is in fluid communication with the hot gas path via the first radial opening.

Those of ordinary skill in the art will better appreciate the features and aspects of such embodiments, and others, upon review of the specification.

BRIEF DESCRIPTION OF THE DRAWINGS

A full and enabling disclosure of various embodiments, including the best mode thereof to one skilled in the art, is set forth more particularly in the remainder of the specification, including reference to the accompanying figures, in which.

DETAILED DESCRIPTION

Figure 1:
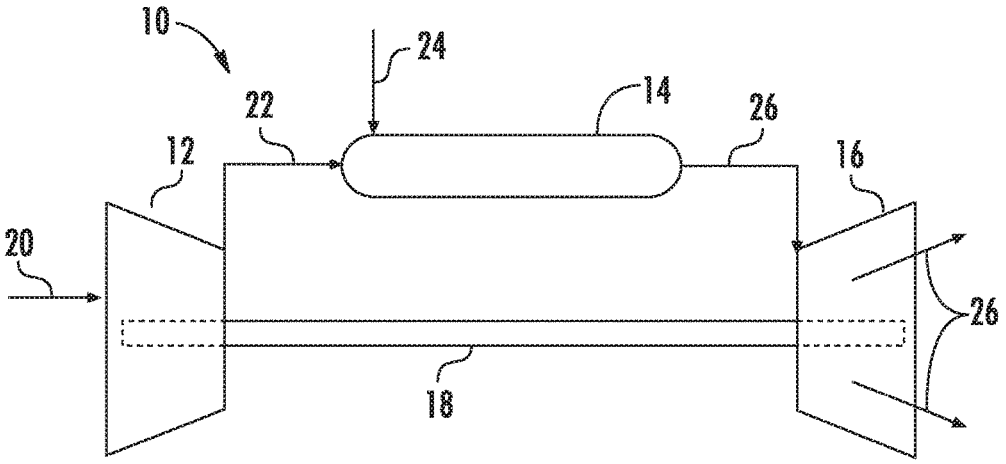
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a combustor for a land based power generating gas turbine for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes a compressor 12, at least one combustor 14 disposed downstream of the compressor 12 and a turbine 16 disposed downstream of the combustor 14. Additionally, the gas turbine 10 may include one or more shafts 18 that couple the compressor 12 to the turbine 16.

During operation, air 20 flows into the compressor 12 where the air 20 is progressively compressed, thus providing compressed or pressurized air 22 to the combustor 14. At least a portion of the compressed air 22 is mixed with a fuel 24 within the combustor 14 and burned to produce combustion gases 26. The combustion gases 26 flow from the combustor 14 into the turbine 16, wherein energy (kinetic and/or thermal) is transferred from the combustion gases 26 to rotor blades (not shown), thus causing shaft 18 to rotate. The mechanical rotational energy may then be used for various purposes such as to power the compressor 12 and/or to generate electricity. The combustion gases 26 may then be exhausted from the gas turbine 10.

Figure 2:
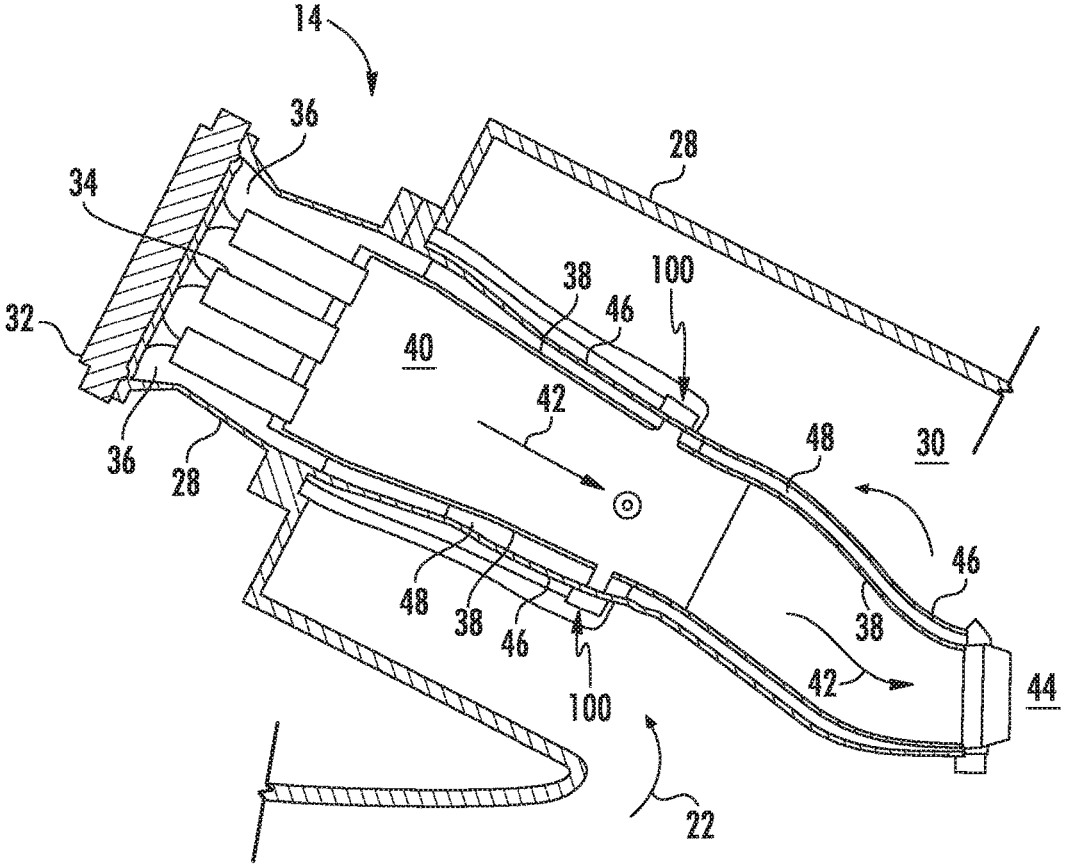
FIG. 2 is a simplified cross-section side view of an exemplary combustor as may incorporate various embodiments of the present disclosure.

FIG. 2 provides a cross-sectioned side view of an exemplary combustor 14 as may incorporate various embodiments of the present disclosure. As shown in FIG. 2, the combustor 14 may be at least partially surrounded by an outer casing 28 such as a compressor discharge casing. The outer casing 28 may at least partially define a high pressure plenum 30 that at least partially surrounds various components of the combustor 14. The high pressure plenum 30 may be in fluid communication with the compressor 12 (FIG. 1) so as to receive a portion of the compressed air 22 therefrom. An endcover 32 may be coupled to the outer casing 28. One or more fuel nozzles 34 may extend axially downstream from the endcover 32. In particular embodiments, the endcover 32 and the outer casing 28 may at least partially define a head-end volume 36 upstream from the one or more fuel nozzles 34.

One or more combustion liners or ducts 38 may at least partially define a combustion chamber or zone 40 downstream from the one or more fuel nozzles 34 and/or may at least partially define a hot gas path 42 through the combustor 14 for directing the combustion gases 26 (FIG. 1) towards an inlet 44 to the turbine 16. In particular embodiments, the combustion liner 38 may be formed from a singular body or unibody having an upstream or forward end that is substantially cylindrical or round. The combustion liner 38 may then transition to a non-circular or substantially rectangular cross-sectional shape proximate to a downstream or aft end of the combustion liner 38.

In particular embodiments, the combustion liner 38 is at last partially circumferentially surrounded by an outer sleeve 46. The outer sleeve 46 may be formed as a single component or formed by multiple sleeve segments such as by a flow sleeve and an impingement sleeve. The outer sleeve 46 is radially spaced from the combustion liner 38 so as to define a cooling flow passage 48 therebetween. The outer sleeve 46 may define a plurality of inlets or holes (not shown) which provide fluid communication between the cooling flow passage 48 and the high pressure plenum 30. The cooling flow passage 48 provides a flow path between the high pressure plenum 30 and the head-end volume 36. In various embodiments, as shown in FIG. 2, the combustor 14 includes at least one fuel injector assembly 100 which is radially oriented and axially offset from the fuel nozzle(s) 34.

Figure 3:
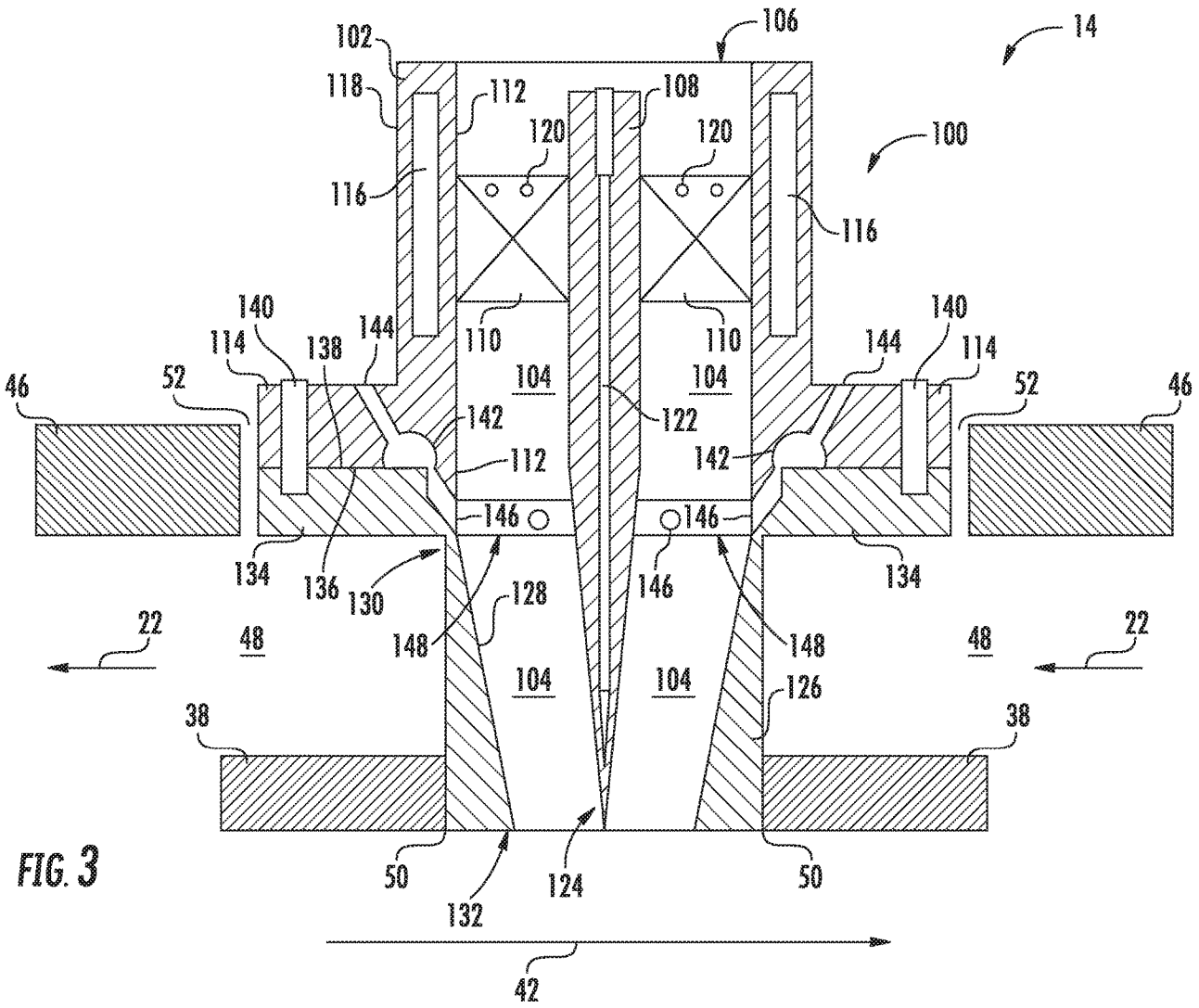
FIG. 3 is a cross-sectioned side view of a portion of the combustor as shown in FIG. 2 including a portion of a combustion liner, a portion of an outer sleeve and an exemplary fuel injector assembly, according to at least one embodiment of the present disclosure.

FIG. 3 provides a cross-sectioned side view of a portion of the combustor 14 including a portion of the combustion liner 38, a portion of the outer sleeve 46 and the fuel injector assembly 100 as shown in FIG. 2, according to at least one embodiment of the present disclosure. In various embodiments, as shown in FIG. 3, the fuel injector assembly 100 includes an injector body 102. The injector body 102 partially defines a flow passage 104 of the fuel injector assembly 100. The injector body 102 also defines an inlet 106 to the flow passage 104. In particular embodiments, the inlet 106 is in fluid communication with the high pressure plenum 30 (FIG. 2).

In particular embodiments, a centerbody 108 extends coaxially within the flow passage 104. A plurality of swirler or turning vanes 110 extends from the centerbody 108 to an inner surface or wall 112 of the injector body 102. The plurality of turning vanes 110 is annularly arranged around the centerbody 108 with respect to a centerline of the fuel injector assembly 100. In particular embodiments, the injector body 102 includes a flange or projection 114 that extends outwardly from the centerline of the fuel injector assembly 100 and at least partially circumferentially around the injector body 102.

In particular embodiments, the injector body 102 may include and/or define a fuel plenum 116 disposed within the injector body 102 between the inner wall 112 and an outer wall 118 of the injector body 102. Each or at least one turning vane 110 of the plurality of turning vanes 110 may include at least one fuel port 120 which is in fluid communication with the fuel plenum 116. In particular embodiments, the centerbody 108 may define a fluid passage 122 therein. The fluid passage 122 may be used to provide fuel to the hot gas path 42 via the centerbody 108 and/or to provide cooling air to a downstream end or tip portion 124 of the centerbody 108.

As further shown in FIG. 3, the fuel injector assembly 100 includes a boss or collar 126. The boss 126 includes an inner surface or wall 128. The inner wall 128 further defines the flow passage 104 of the fuel injector assembly 100. In particular embodiments, the at least a portion of the inner wall 128 of the boss 126 converges radially inwardly from an upstream end 130 of the boss 126 towards a downstream end or outlet 132 of the boss 126 with respect to the centerline of the fuel injector assembly 100. At least a portion of the centerbody 108 may extend at least partially through the portion of the flow passage 104 defined by the boss 126.

In particular embodiments, the boss 126 is rigidly connected to the combustion liner 38. For example, the boss 126 may be welded or mechanically fastened via bolts or the like. In particular embodiments, the boss 126 may be cast or formed as part of the combustion liner 38. The downstream end 132 of the boss 126 extends into and/or circumferentially surrounds or defines a first radial opening 50 through the combustion liner 38. The first radial opening 50 is defined downstream from the fuel nozzle(s) 34 and provides for fluid communication from the flow passage 104 of the fuel injector assembly 100 into the hot gas path 42.

In particular embodiments, as shown in FIG. 3, the boss 126 includes a projection or flange 134 that extends outwardly from and at least partially circumferentially around the upstream end 130 of the boss 126. A mating surface 136 of the flange 114 of the injector body 102 and a mating surface 138 of the projection 134 of the boss 126 are each formed so as to abut or connect to each other when the injector body 102 and the boss 126 are coupled or assembled together. In particular embodiments, a pin, bolt or other mechanical fastener or fasteners 140 may be used to couple or connect the injector body 102 to the boss 126.

As shown in FIG. 3, the flange 114 of the injector body 102 and/or the projection 134 of the boss 126 may be disposed within and/or extend through a second radial opening 52 defined by the outer sleeve 46. The second radial opening 52 may be sized so as to allow for differential axial and/or radial growth between the combustion liner 38 and the outer sleeve 46 during thermal transients of the combustor 14.

In particular embodiments, as shown in FIG. 3, the fuel injector assembly 100 may include a purge air manifold 142. In particular embodiments, the purge air manifold 142 may be at least partially defined by the injector body 102. In particular embodiments, the purge air manifold 142 may be partially defined by the injector body 102 and by the boss 126. The injector body 102 may define at least one manifold inlet 144 that is in fluid communication with a purge air source such as but not limited to the high pressure plenum 30 and that is in fluid communication with the purge air manifold 142.

In particular embodiments at least one of the injector body 102 and the boss 126 defines a plurality of manifold outlets 146 circumferentially spaced about at least one of the inner wall 112 of the injector body 102 and the inner wall 128 of the boss 126. Each manifold outlet 146 is in fluid communication with the purge air manifold 142. One or more manifold outlets 146 of the plurality of manifold outlets 146 may be disposed or formed along or proximate to a joint 148 that is formed where the inner wall 112 of the injector body 102 and the inner wall 128 of the boss 126 intersect. Due to tolerances and/or alignment issues, the inner wall 112 of the injector body 102 and the inner wall 128 of the boss 126 may not form a smooth continuous surface at the joint 148, thereby potentially resulting in flow disruptions within the flow passage 104 across the joint 148. During operation, a purge medium such as a portion of the compressed air 22 may enter the purge air manifold 142 via the inlet(s) 144 and exit the purge air manifold via the outlets 146, thereby providing a film of air across the joint 148, thereby reducing flow disruptions within the flow passage 104.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fuel injector assembly, comprising:

an injector body having an inner wall that extends axially through the injector body and a flange that extends radially outward with respect to a centerline of the fuel injector assembly;

a boss rigidly connected to the injector body, the boss including an inner wall and a flange that extends radially outward from an upstream end of the boss, a mating surface of the flange of the injector body abutting a mating surface of the flange of the boss, wherein the inner wall of the boss and the inner wall of the injector body together define a flow passage of the fuel injector assembly, wherein the injector body defines an inlet to the flow passage and the boss defines an outlet of the flow passage;

a purge air manifold defined by and between the flange of the injector body and the flange of the boss;

a purge air inlet defined by the injector body and in fluid communication with the purge air manifold; and a plurality of circumferentially spaced outlets in fluid communication with the purge air manifold.

2. The fuel injector assembly as in claim 1, wherein at least one outlet of the plurality of outlets is disposed at or upstream from a joint defined between the inner wall of the injector body and the inner wall of the boss.

3. The fuel injector assembly as in claim 1, wherein the inner wall of the boss converges inwardly with respect to the centerline of the fuel injector assembly between a joint defined between the inner wall of the injector body and the inner wall of the boss and the outlet from the flow passage defined by the boss.

4. The fuel injector assembly as in claim 1, further comprising a centerbody that extends coaxially within the flow passage.

5. The fuel injector assembly as in claim 4, further comprising a plurality of circumferentially spaced turning vanes that extends from the centerbody to the inner wall of the injector body.

6. The fuel injector assembly as in claim 5, wherein the injector body defines a fuel plenum between the inner wall of the injector body and an outer wall of the injector body, wherein one or more turning vanes of the plurality of turning vanes is in fluid communication with the fuel plenum.

7. The fuel injector assembly as in claim 1, wherein the injector body is connected to the boss via a mechanical fastener.

8. A combustor, comprising:

a combustion liner defining a hot gas path and a first radial opening; and a fuel injector assembly, the fuel injector assembly including:

an injector body having an inner wall that extends axially through the injector body and a flange that extends radially outward with respect to a centerline of the fuel injector assembly;

a boss including an inner wall and a flange that extends radially outward from an upstream end of the boss, wherein the flange of the boss is rigidly connected to the flange of the injector body and wherein a downstream end of the boss is connected to the combustion liner, wherein the inner wall of the boss and the inner wall of the injector body together define a flow passage of the fuel injector assembly, wherein the flow passage is in fluid communication with the hot gas path via the first radial opening;

a purge air manifold defined by and between the flange of the injector body and the flange of the boss;

a purge air inlet defined by the injector body and in fluid communication with the purge air manifold; and a plurality of circumferentially spaced outlets in fluid communication with the purge air manifold.

9. The combustor as in claim 8, wherein the injector body defines an inlet to the flow passage and the boss defines an outlet of the flow passage.

10. The combustor as in claim 8, wherein at least one outlet of the plurality of outlets is disposed at or upstream from a joint defined between the inner wall of the injector body and the inner wall of the boss.

11. The combustor as in claim 8, wherein the inner wall of the boss converges inwardly with respect to the centerline of the fuel injector assembly between a joint defined between the inner wall of the injector body and the inner wall of the boss and the outlet from the flow passage defined by the boss.

12. The combustor as in claim 8, wherein the fuel injector assembly further comprises a centerbody that extends coaxially within the flow passage.

13. The combustor as in claim 12, wherein the fuel injector assembly further comprises a plurality of circumferentially spaced turning vanes that extends from the centerbody to the inner wall of the injector body.

14. The combustor as in claim 13, wherein the injector body defines a fuel plenum between the inner wall of the injector body and an outer wall of the injector body, wherein one or more turning vanes of the plurality of turning vanes is in fluid communication with the fuel plenum.

15. The combustor as in claim 8, further comprising an outer sleeve defining a second radial opening, the outer sleeve at least partially surrounding the combustion liner, wherein the outer sleeve is radially spaced from the combustion liner so as to define a cooling flow passage therebetween, wherein the fuel injector assembly extends radially through the second radial opening.

* * * * *